United States Patent [19]

Steine et al.

[11] Patent Number: 4,935,266

[45] Date of Patent: Jun. 19, 1990

[54] PROCESS AND MATERIAL FOR PRODUCING CORROSION-RESISTANT LAYERS

[75] Inventors: Hans-Theo Steine, Chavannes/Lausanne; Christopher Wasserman, Lausanne, both of Switzerland

[73] Assignee: Castolin, S.A., St., Sulpice, Switzerland

[21] Appl. No.: 213,711

[22] Filed: Jun. 30, 1988

[30] Foreign Application Priority Data

Jul. 8, 1987 [DE] Fed. Rep. of Germany ..... 3722532

[51] Int. Cl.[5] ..... B05D 1/10

[52] U.S. Cl. ..... 427/423; 420/12; 420/63

[58] Field of Search ..... 75/251, 252; 420/12; 427/423

[56] References Cited

U.S. PATENT DOCUMENTS 4,019,875 4/1977 Dittrich et al. ..... 75/252 X 4,348,433 9/1982 Kammer et al. ..... 427/423

4,361,604 11/1982 Kushner et al. ..... 427/423

*Primary Examiner*—Evan Lawrence

*Attorney, Agent, or Firm*—Bachman & LaPointe

[57] ABSTRACT

A process for producing a corrosion-resistant protection on stabilizing wall surfaces and superheater tubes in sulfur-bearing hot gases which are used at surfaces temperatures of over 400° C. in combustion installations, and a material in powder form which is suitable for that process, are intended to make it possible to use such wall surfaces and superheater tubes in sulfur-bearing hot gases in a good and durable fashion.

For that purpose, to form a protective layer which is preferably from 0.2 to 1.5 mm in thickness, a metal powder which is sprayed out of a molten state, of a given composition, with a surface area of more than 200 $cm^2/g$, is applied with an autogenous flame spray torch, with a quantitative gas flow rate of between about 1000 to 3000 NL/h, or 1500 to 2500 NL/h, for the combustion gas. The preferred composition of the metal powder used in Cr 15% to 35%, Mn 0.05% to 3%, Mo 0.05% to 5.0%, C 0.1% to 3%, Si 0.1% to 3%, Al 2% to 15%, with the balance Fe.

10 Claims, 2 Drawing Sheets

PROCESS AND MATERIAL FOR PRODUCING CORROSION-RESISTANT LAYERS

The invention relates to a material in powder form and a process for the production of a corrosion-resistant protection on fixed or stabilising wall surfaces and superheater tubes in sulfur-bearing hot gases, which are used at surface temperatures of over 400° C. in combustion installations.

Fixed or stabilising wall surfaces, in particular in large-scale firing installations, for example in thermal power stations, garbage incinerator installations and the like, suffer from severe corrosion phenomena, in dependence on the liquid, gaseous or solid fuel used, in the tubulence zone of the flame or the fire ball.

The origin of such corrosive attack is to be attributed to the oxidising or reducing flame and to the various oxides of elements in the flame gases such as for example $SO_2$ or CO. Hitherto, the pipes or parts of the stabilising wall surface are cut out at the heavily corroded points, and replaced by fresh components. When using plasma and wire spray processes, it was possible to avoid such a replacement operation in part or in restricted situations. However those coatings exhibited unsatisfactorily short service lives or, when used a bonding layer, exhibited peel-off phenomena.

Particular difficulties occur due to the size of the spray installations required and the level of noise which occurs in the spraying operation and which makes it necessary to operate with ear protectors. In addition the spray distances which are to be maintained in such processes, for the purposes of applying a constant layer, are difficult to maintain when operating in boiler installations.

There were considerable objections and misgivings on the part of the men skilled in the art, in regard to the use of per se known autogenous flame spray torches, for which reason such devices were not used in the area under consideration.

In the light of those facts, the inventor set himself the aim of improving the process set forth in the opening part of this specification, while avoiding the disadvantages recognised therein, and providing a material in powder form which is suitable therefor and which can be used satisfactorily and durably in sulfur-bearing hot gases.

In the process according to the invention, to form a protective layer, which is preferably from 0.2 to 1.5 mm in thickness, a metal powder of a given composition with a surface area of more than 200 $cm^2/g$, is sprayed in a molten state and is applied with an autogenous flame spray torch, with a quantitative gas flow rate of between about 1000 to 3000 NL/h, or 1500 to 2500 NL/h, for the combustible gas. The powder is applied at a rate of 3 through 10 kg/h, preferably at a rate of 4 through 8 kg/h, and the torch is used so as to form a spray distance of 150 to 250 mm. In that connection the preferred composition of the metal powder used is Cr 15% to 35%, Mn 0.05% to 3%, Mo 0.05% to 5.0%, C 0.1% to 3%, Si 0.1% to 3%, Al 2% to 15%, with the balance Fe.

Preferred ranges are Cr 20% to 30%, Mn 0.1% to 2%, Mo 0.1% to 4%, C 0.1% to 3%, Si 0.5% to 2%, Al 3% to 10% and the balance Fe.

The layer is of a uniform structure and is sprayed on without bonding primer. The homogeneity and composition of the material provides good resistance to corrosion in sulfur-bearing hot gases with a sulfur content of over 0.2 to 5%.

Further advantages, features and details of the invention will be apparent from the following description of a preferred embodiment and with reference to the drawing in which.

Figure 1:
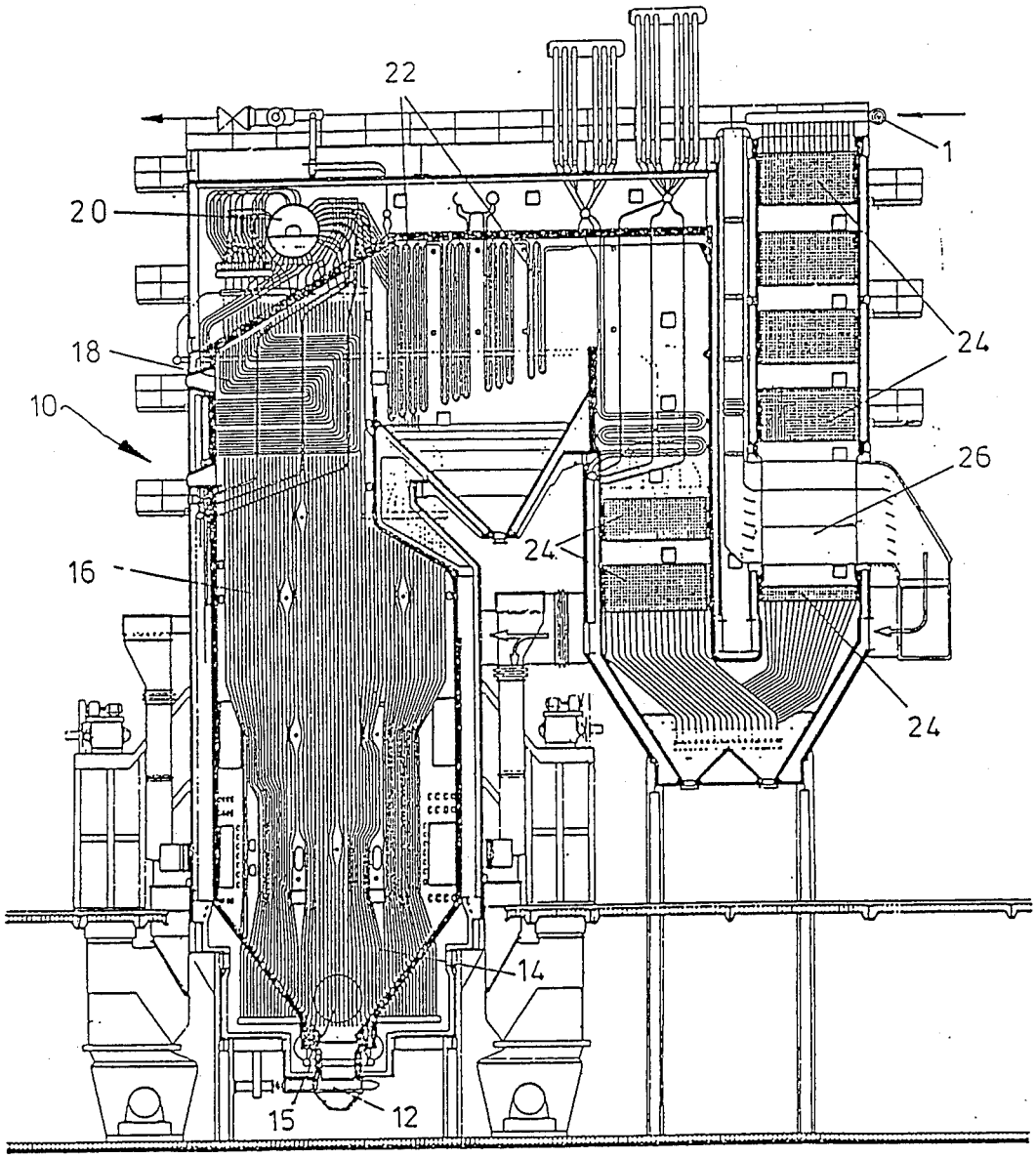
FIG. 1 is a view in cross-section of a vertical-tube boiler.

A vertical-tube boiler 10 for coal firing comprises, above an ash removal device 12, a combustion chamber 14 with burner 15 and a plurality of water tubes 16 at the boiler walls 17. Reference numeral 18 denotes platen superheaters below a boiler drum 20, reference numeral 22 denotes contact superheaters 24, and reference numeral 24 denotes feed water preheaters or economisers. Air preheaters 26 are arranged at the right-hand side of FIG. 1 between the feed water preheaters 24 in which the feed water is preheated with the exhaust gases from the boiler installation, saving on fuel and reducing the thermal stresses in the boiler. In the superheaters 18 and 22 saturated steam is raised to a higher temperature without an increase in pressure, that is to say it is superheated.

Figure 2:
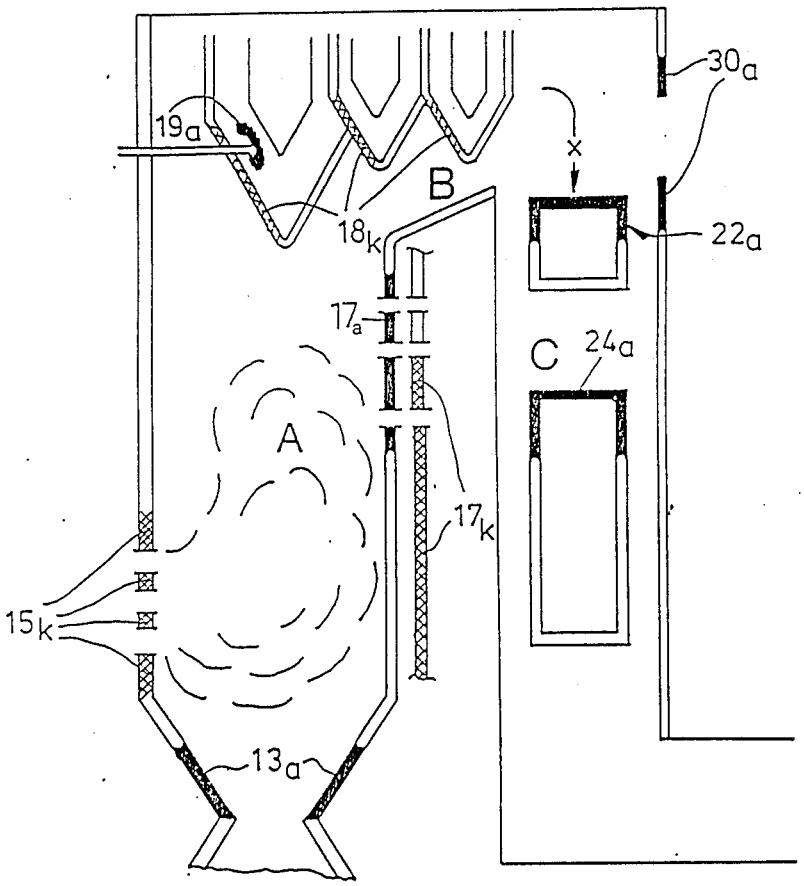
FIG. 2 is a diagrammatic view of the vertical-tube boiler.

FIG. 2 shows typical loading zones in respect of corrosion (index k) and erosion (index a). Corrosion phenomena occur primarily at the burner $\mathbf{15}_k$, at the boiler wall $\mathbf{17}_k$ and at the platen superheaters $\mathbf{18}_k$ whereas erosion phenomena occur below the firing chamber 14 at $\mathbf{13}_a$ at the boiler wall at $\mathbf{17}_a$, at the soot blower $\mathbf{19}_a$ of the platen superheater 18, at the contact superheaters $\mathbf{22}_a$ which are the first in the direction of flow as indicated by x, and at the preheater $\mathbf{24}_a$. In addition erosion occurs at an upper access opening $\mathbf{30}_a$.

The temperatures in the firing chamber which are subjected to corrosion and oxidation loadings are approximately between 1000° and 1200° C. (zone A), in zone B they are about 700° C. and in the region of the preheaters 24 and 26 they are about 400° C. (zone C).

The powder materials according to the invention are applied by a thermal spraying operation to stabilising wall surfaces and superheater tubes, which are operated at surfaces temperatures of far higher than 400° C.

We claim:

1. A process for producing a corrosion-resistant protection layer on wall surfaces and on tube surfaces in a combustion installation exposed to sulfur-bearing hot gases and subjected to surface temperatures above 400° C. characterized by the steps of:

forming a protective layer on said wall surfaces and tube surfaces; and said forming step comprising providing a metal powder in a molten state having a composition consisting essentially of from 15% to 35% chromium, from 0.05% to 3.0% manganese, from 0.05% to 5.0% molybdenum, from 0.1% to 3.0% carbon, from 0.1% to 3.0% silicon, from 2.0% to 15% aluminum and the balance iron, and applying said metal powder in said molten state with a surface area of more than 200 $cm^2/g$ to said surfaces using an autogenous flame spray torch at a gas flow rate of between about 1000 NL/h to 3000 NL/h for the combustible gas.

2. The process of claim 1 wherein:

said metal powder providing step comprises providing a metal powder having a composition consisting essentially of from 20% to 30% chromium, from 0.1% to 2.0% manganese, from 0.1% to 4.0% molybdenum, from 0.1% to 2.9% carbon, from 0.5% to 2.0% silicon, from 3.0% to 10% aluminum and the balance iron.

3. The process of claim 1 wherein:

said applying step comprises applying said metal powder using said autogenous flame spray torch at a gas flow rate of between 1500 to 2500 NL/h.

4. The process of claim 1 wherein said applying step further comprises applying said metal powder at a rate of 3 through 10 kg/h.

5. The process of claim 1 wherein said applying step further comprises applying said metal powder at a rate of 4 through 8 kg/h.

6. The process of claim 1 wherein said applying step further comprises using said torch so as to form a spray distance of 150 to 250 mm.

7. The process of claim 1 wherein said layer forming step comprises forming a layer having a thickness of 0.2 to 1.5 mm.

8. A material to be used in a process for producing a corrosion-resistant protection layer on wall surfaces and on tube surfaces in a combustion installation exposed to sulfur-bearing hot gases and subjected to surface temperatures above 400° C., said material being in powder form and consisting essentially of:

15% to 35% chromium;
0.05% to 3.0% manganese;
0.05% to 5.0% molybdenum;
0.1% to 3.0% carbon;
0.1% to 3.0% silicon;
2.0% to 15% aluminum; and
the balance iron.

9. The material of claim 8 wherein said material consists essentially of 20% to 30% chromium, 0.1% to 2.0% manganese, 0.1% to 4.0% molybdenum, 0.1% to 2.9% carbon, 0.5% to 2.0% silicon, 3% to 10% aluminum, and the balance iron.

10. The material of claim 8 further comprising said material in said powder form having an aspherical grain shape.

* * * * *